US005412887A

United States Patent [19]

Layne

[11] Patent Number: 5,412,887

[45] Date of Patent: May 9, 1995

[54] ILLUMINATED DISPLAY ASSEMBLY FOR CONSUMER PRODUCTS

[76] Inventor: James R. Layne, 5673 E. Eastland, Tucson, Ariz. 85711

[21] Appl. No.: 7,515

[22] Filed: Jan. 22, 1993

[51] Int. Cl.[6] ..... A47G 1/06; G09F 13/00

[52] U.S. Cl. ..... 40/152.2; 40/642; 362/806; 206/387.1; 206/308.1

[58] Field of Search ..... 40/152.2, 204, 642; 362/886, 249; 206/387

[56] References Cited

U.S. PATENT DOCUMENTS

| | | | |
|---|---|---|---|
| 1,348,957 | 8/1920 | Pope | 40/152.2 |
| 3,226,866 | 1/1966 | DePoray | 40/152.2 |
| 4,748,756 | 6/1988 | Ross | 40/152.2 |
| 4,922,384 | 5/1990 | Torrence | 362/806 |
| 4,942,685 | 7/1990 | Lin | 40/152.2 |
| 4,947,989 | 8/1990 | Horton | 206/387 |
| 5,111,606 | 5/1992 | Reynolds | 40/642 |

FOREIGN PATENT DOCUMENTS

| | | | |
|---|---|---|---|
| 687441 | 2/1953 | United Kingdom | 40/152.2 |

*Primary Examiner*—Thomas E. Denion

[57] ABSTRACT

An illuminated display assembly (10) for a consumer product (72) such as a video tape, compact disc, book, audio tape, and the like. The display assembly (10) having a frame casing (11) with a generally rectangular opening (12) designed to receive the consumer product (72). The opening (12) is defined by parallel top and bottom interior walls (14)(16), joined by interior side walls (18)(20), relating substantially to the corresponding vertical and horizonal dimensions of the consumer product (72). Within the frame casing (11) is housed one or more light elements (36) which are programmed to illuminate in various fashions to draw the attention of the consumer to the consumer product (72).

5 Claims, 4 Drawing Sheets

ILLUMINATED DISPLAY ASSEMBLY FOR CONSUMER PRODUCTS

BACKGROUND—FIELD OF INVENTION

The present invention generally relates to consumer product display units and, more particularly to an illuminated display unit for a compact disc, book, audio tape, computer game cartridge, or video tape.

Background—Description of Prior Art

In recent years, the retail sales and rental of software such as compact discs, video tapes, audio tapes, and computer games has become a large and evergrowing industry. Heretofore, the displaying of this type of consumer product within the retail environment has typically been limited to the placement on shelves, racks, counter displays, or the like. For example, the method most commonly used to display video tapes has been the placement on shelves, side by side, in a manner which allows the customer to easily view a wide variety of video tapes. In this connection, it is well known that the containers for such consumer products typically have visually interesting art work on the front face thereof. In addition to identifying the video tapes, etc., this art work is designed to promote and "sell" the product to the consumer. Within a rack, shelf, or counter configuration, a vast variety of video tapes may be displayed. Thus, there has been a need for an additional display unit which would take full advantage of the attractive artwork of the individual video tape, etc., and display it in a manner which would set it apart from other simular product. U.S. Pat. No. 4,919,287 issued to Wayne J. Haskett et. al. on Apr. 24, 1990 discloses a display unit for consumer products. Haskett teaches a display unit for displaying compact discs, audio tapes, video tapes and the like. Though Haskett's invention provides for the display of a plurality of consumer products in a manner which allows for convenient viewing, all products are displayed identically. Unlike the present invention, Haskett's display unit does not provide for the visual enhancement of one particular consumer product over the other. Haskett's display unit includes a rectangular opening adapted to receive the consumer product which resembles the rectangular opening of the present invention. However, apart from this simularity, there is little relationship between Haskett's and the present invention.

U.S. Pat. No. 5,111,606 issued to Randy Reynolds on May 12,1992 is relevant prior art in that it discloses a merchandising display device, receiving advertising cards and which has a peripheral edge containing lights which are energized by a battery. However, Reynolds device does not mention or allow for the physical display of the actual retail consumer product, but in fact displays advertisement signage. In this regard, the present invention has solved a problem that has not been recognized and the results achieved are new, superior, and unexpected.

Perhaps a more relevant prior art is U.S. Pat. No. 4,947,989 issued to Azor R. Horton on Aug. 14, 1990 which discloses a video tape storage box with showcase cover sleeve. Horton teaches a video cassette storage container with a removeable illuminated cover. Horton's invention proposes a retail display solution simular to that of the present invention. However, in view of the current video retailing industry practices, it's design and functions are limited. Horton's display device incorporates an illumination system to enhance the display of a single sheet of inducia attached to the front of a plastic video storage container. However, it cannot display an actual factory sealed video tape nor the empty cardboard containers, i.e. video boxes, most commonly displayed in a video rental store.

As one familiar with the art would recognize, video tapes offered for sale are packaged in sealed cardboard containers on which the title and various art work is printed. In a display environment where videos are offered for rent, it is the displaying of these video boxes, and not neccesarily the actual video tapes, which assist the consumer in making their selections.

Thus, prior art heretofore is known to suffer from the following disadvantages:

a) The display device is designed exclusively for use with video tapes.
b) The display device must be used in conjunction with a plastic video storage container.
c) The display device does not allow for the insertion and display of a factory sealed video tape.
d) The display device does not allow for the insertion and display of an empty video box container.
e) The display device does not provide a support structure to allow the device to stand in an upright configuration. Thus the device is required to lean upon an existing shelf structure limiting its' use.
f) The use of the display device requires the user to provide a flat sheet of inducia which is displayed on the front of the unit. Thus, if the user wanted to display the box art from a particular video tape, the box would have to be mutilated to allow the front cover to be displayed in the unit. For the majority of video retailers, this requirement would deem the unit inappropiate for use.

The present invention is directed to overcome the foregoing display limitations and accomplish the resulting objectives by providing a unique new display unit for consumer products.

OBJECTS AND ADVANTAGES

Accordingly, several objects and advantages of the present invention are listed as follows:

a) The present invention will provide a display device that may be designed for a variety of consumer products such as video tapes, compact discs, audio tapes, computer game cartridges, and the like.
b) The present invention will provide a display unit which is all inclusive, requiring no additional storage containers to display an individual consumer product.
c) The present invention will provide a display unit which allows the insertion and subsequent displaying of an individual factory sealed video tape.
d) The present invention will provide a display unit which allows the insertion and subsequent displaying of an individual empty container of the consumer product. Because the majority of retailers who rent products such as video tapes use this empty container display method, the present invention offers a great advantage over prior art.
e) The present invention will provide a display unit which allows the insertion and display of a consumer product in such a way as not to alter or mutilate the package container, i.e. video box, etc.
f) The present invention will provide a display unit which has the ability to support itself in an upright position thereby enhancing it's capabilities and purpose.

g) The present invention will provide a display unit which is visually attractive, and which will contribute to the overall asthetics of the retail environment. The manner in which products are displayed within the retail environment has a direct effect on the consumer. Thus, in addition to promoting individual products, the present invention will enhance the overall look and feel of the retail environment, creating a positive effect on the consumer.

h) The present invention will provide a display unit which incorporates an illumination system which is used to draw attention to the consumer product, increasing the probability that the product will be viewed by the customer. This, theoretically should increase the sale or rental of the particular product.

Accordingly, the present invention provides a unique and advantageous illuminated display assembly that is inexpensive to manufacture, assemble, and maintain, and that provides for the ease and convenience of changing or replacing the consumer products. Further objects and advantages of my invention will become apparent from a consideration of the drawings and ensuing description of it.

DRAWING FIGURES

Figure 1:
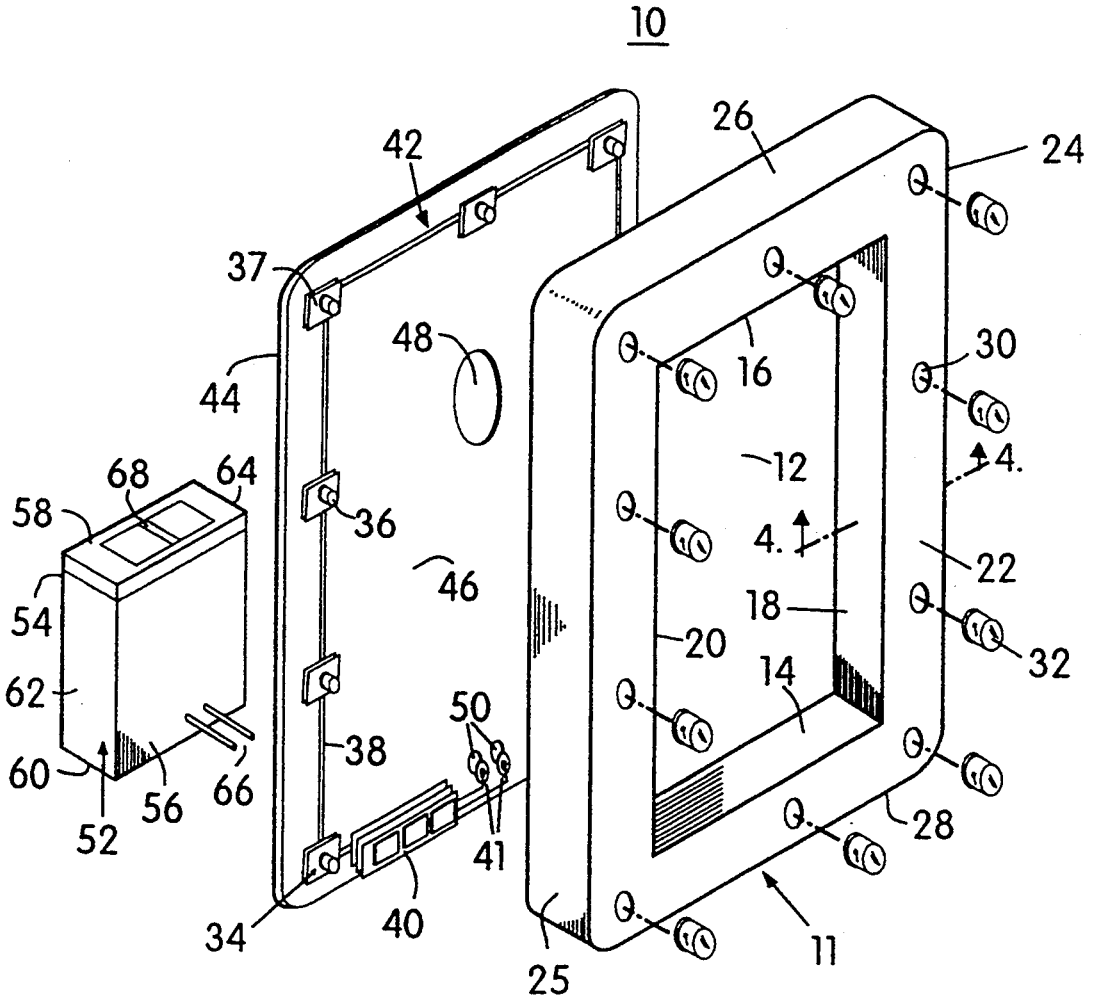
FIG. 1 is an exploded pictorial view of a display assembly constructed in accordance with and emboding the features of the present invention.

| Reference Numerals In Drawings | |
|---|---|
| 10 display assembly | 11 frame casing |
| 12 opening | 14 interior end wall |
| 16 interior end wall | 18 interior side wall |
| 20 interior side wall | 22 front wall |
| 24 exterior side wall | 25 exterior side wall |
| 26 top exterior wall | 28 bottom exterior wall |
| 29 tab | 30 light hole |
| 32 lens | 33 flange |
| 34 illumination system | 36 light element |
| 37 light base | 38 conductor wire |
| 40 circuit control module | 41 input sockets |
| 42 back plate | 44 rear wall |
| 46 inside wall | 48 exstraction hole |
| 50 socket holes | 52 battery compartment |
| 54 front wall | 56 rear wall |
| 58 top wall | 60 bottom wall |
| 62 side wall | 64 side wall |
| 66 plug | 68 switch |
| 70 coaxial jack | 72 consumer product |

DESCRIPTION—FIGS. 1 to 5

Figure 2:
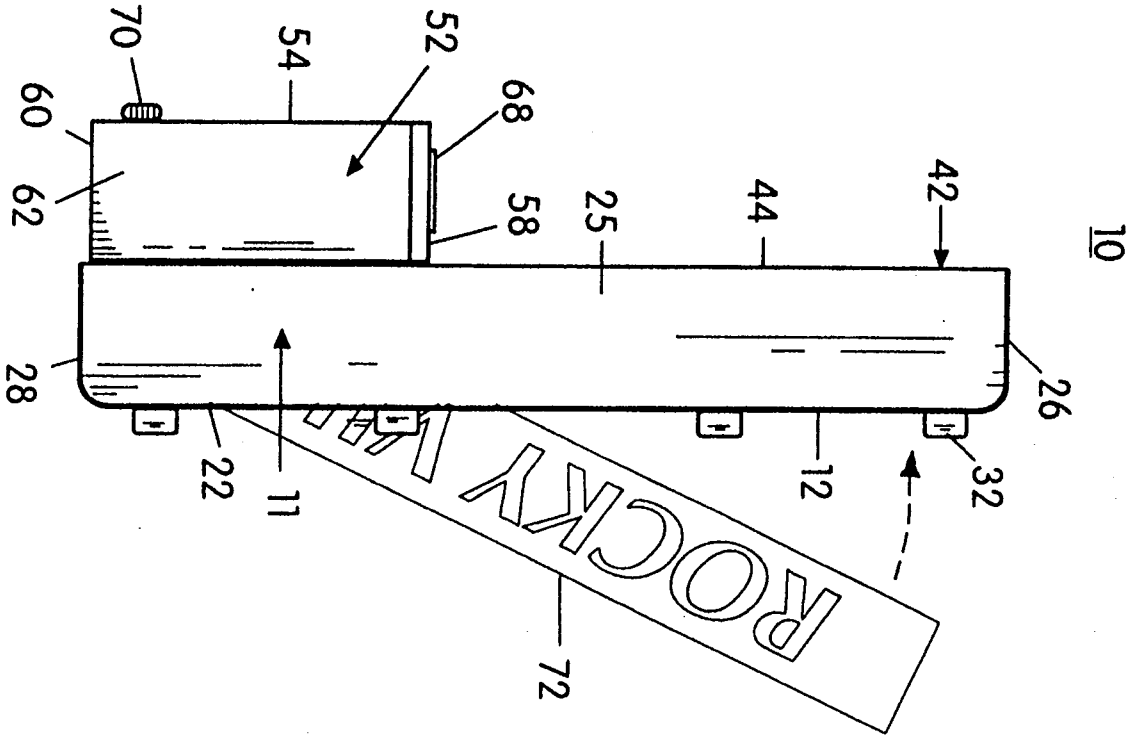
FIG. 2 is a side elevational view of the display assembly of FIG. 1, as viewed from the left-hand side.
Figure 3:
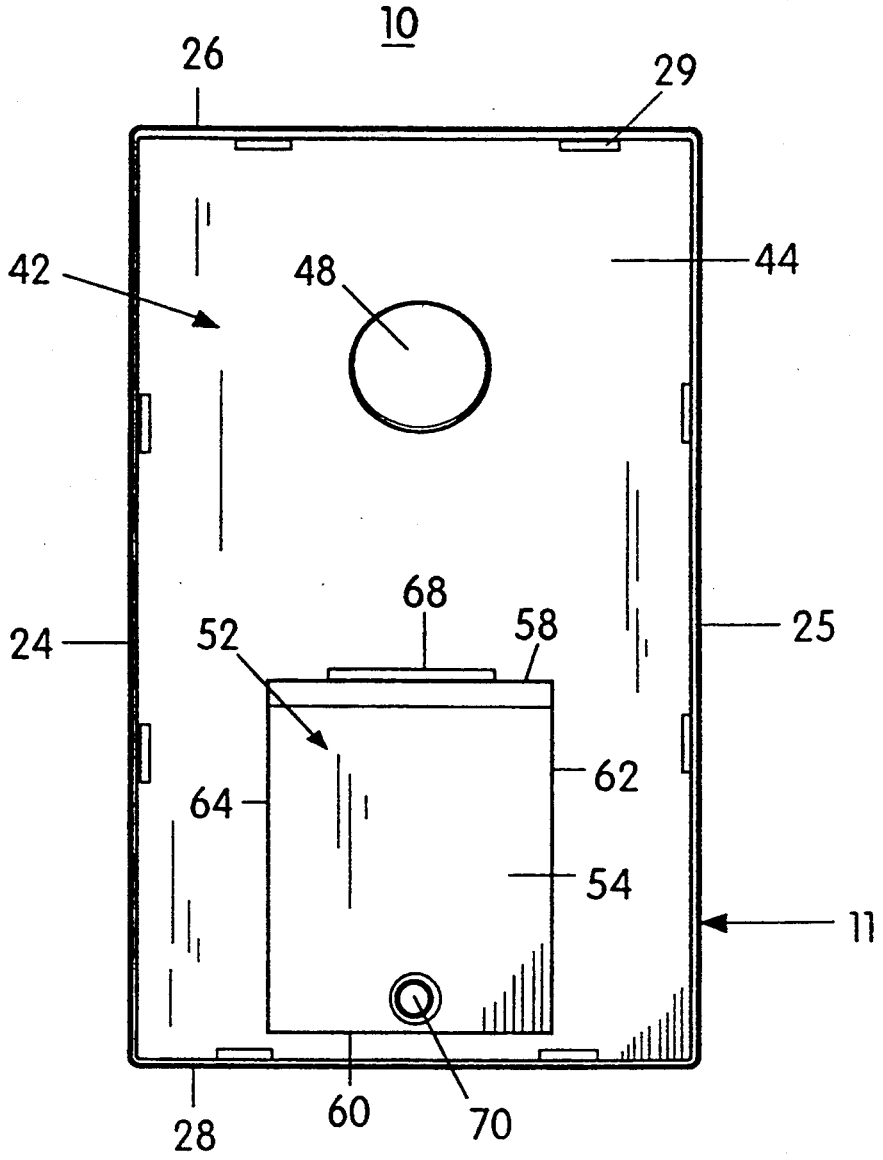
FIG. 3 is a rear elevational view of the display assembly of FIG. 1.
Figure 4:
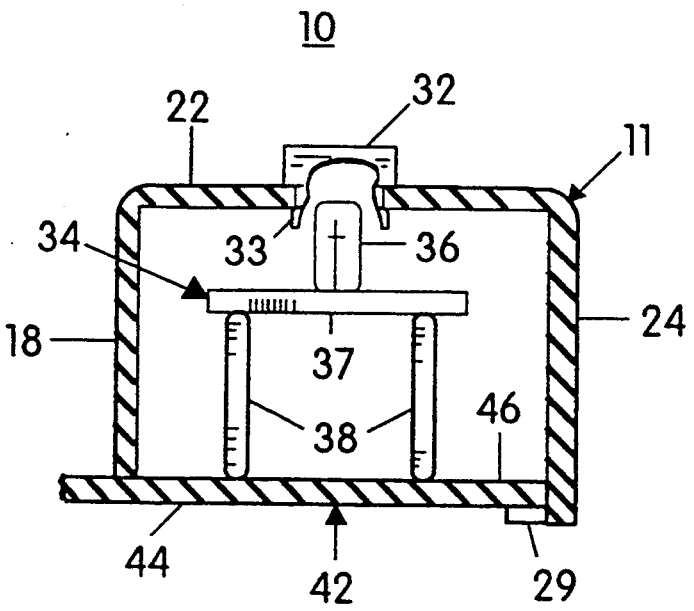
FIG. 4 is an enlarged cross-sectional view taken along the line 4—4 in FIG. 1.
Figure 5:
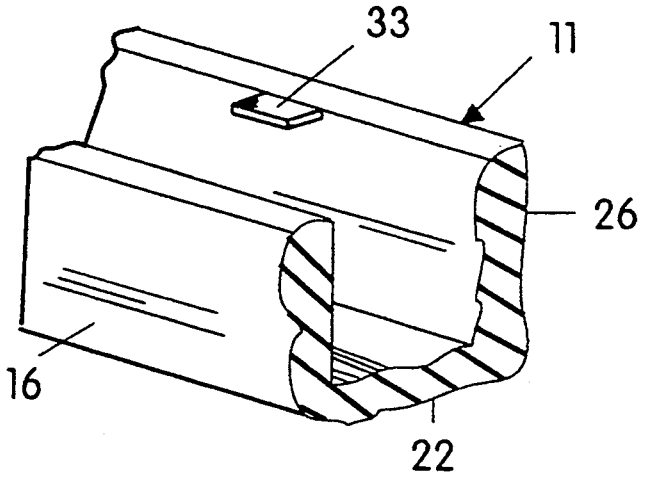
FIG. 5 is an enlarged fragmentary pictorial view showing a securing tab of the display assembly of FIG. 1. Simular reference characters designate corresponding parts throughout the various figures of the drawings.

Referring to the drawings, in FIG.1, 2 and 3 there is illustrated a display assembly generally designated by numeral 10 constructed in accordance with and embodiing the features of the present invention. Display assembly 10 includes a frame casing 11 which has a rectangular consumer product-receiving opening 12 therewithin. Opening 12 is defined by parallel top and bottom interior end walls 14 and 16 joined by interior side walls 18 and 20. Frame casing 11 has a front wall 22, exterior side walls 24 and 25, as well as top and bottom exterior walls 26 and 28. Located within front wall 22 are a plurality of light holes 30. Each light hole 30 accept a lens 32. Display assembly 10 includes a illumination system 34 consisting of a plurality of light elements 36, light bases 37, conductor wires 38, and a circuit control module 40. Electrical input sockets 42 are connected to circuit control module 40 by way of conductor wires 38. Additionally, display assembly 10 includes a back plate 42. Back plate 42 includes a rear wall 44 and a inside wall 46. An exstracting hole 48 is centrally located within back plate 42. Input socket holes 50 are also located within back plate 42. Display assembly 10 includes a battery compartment 52 which is defined by a front wall 54 and a rear wall 56 opposite thereof, as well as a top and bottom walls 58 and 60 joined by parallel side walls 62 and 64. Extending from rear wall 56 is a power output plug 66. Top wall 58 includes an electrical switch 68. Located on front wall 54 is a coaxial input jack 70. Referring to FIG. 4, this cross-section view illustrates lens 32 as having a flange 33. FIG. 5 illustrates a detailed view of the back side of frame casing 11. Inwardly extending tabs 29 protrude from the inside of exterior side walls 24 and 25 and bottom exterior end walls 26 and 28.

Operation—FIG. 1 to 5

Again referring to the drawings there is illustrated a display assembly 10 constructed with and emboding the features of the present invention. Display assembly 10 is designed to accept a consumer product 72 (fig.2) within a generally rectangular opening 12 within frame casing 11. Opening 12 is defined by parallel top and bottom interior end walls 14 and 16 joined by interior side walls 18 and 20.

For illustrative purposes we will be referring to the rectangular consumer product 72 as a video tape or the like. However, any number of various consumer products may be used with display assembly 10 through custom design. Therefore, opening 12 will substantially be the same as the corresponding vertical and horizonal dimensions respective of consumer product 72.

Consumer product 72 is placed within display assembly 10 and held in place by parallel top and bottom interior end walls 14 and 16 joined by interior side walls 18 and 20 of frame casing 11. Inside wall 46 of back plate 42 acts as a barrier means to hold consumer product 72 in place. This permits the insertion of consumer product 72 into opening 12 only through the front side of frame casing 11. The retention means is such that consumer product 72 may be repeatedly inserted into opening 12 and removed from opening 12 on demand. To assist in this function back plate 42 preferably includes an exstracting hole 48 which allows the user to use finger pressure to push consumer product 72 outwardly through opening 12 in frame casing 11. Due to the simple straightforward manner in which consumer product 72 is displayed, a video tape may be displayed within it's own factory sealed box, taking full advantage of the graphics and artwork printed on the box to identify contents. In like manner, an empty box without the video tape ( for shoplifting reasons) may be displayed as well. Frame casing 11 encompasses the entire outer area of display assembly 10 as viewed by the consumer. It should be noted that frame casing 11 is preferably composed of a material that can be efficiently and economically extruded or molded, and that it presents an attractive external appearance in order to form a pleasing and durable structure. Examples of suitable materials include plastics or other synthetics, aluminum, or wood, for example.

Located within front wall 22 of frame casing 11 is a plurality of light holes 30. Holes 30 allow for one or more light elements 36 to be viewed from the front side of frame casing 11. Each light hole 30 may accept a lens 32. Lens or lenses 32 assist in the external dispersement of light emitted from light elements 36. Lens or lenses 32 also complete the cosmetic appearance of display assemply 10. Preferably lens or lenses 32 are interconnected with, and retained on, corresponding front wall 22 of frame casing 11. Perhaps best shown in FIG. 4, lens or lenses 32 preferably include a pair of spaced apart flanges 33 which assist in interlockingly, but removably, interconnecting lens or lenses 32 with front wall 22 of frame casing 11.

In accordance with the present invention display assembly 10 is equipped with a preferably multi-light illumination system 34 encased between frame casing 11 and back plate 42. Illumination system 34 includes one or more light elements 36 disposed within front wall 22 of frame casing 11 through a directly corresponding number of light holes 30 and lenses 32. Light elements 36 are received into light base 37 which are electrically interconnected by way of conductor wires 38 to circuit control module 40, and ultimately to a power supply such as battery compartment 52. Light elements 36 may be any suitable light source, but are preferably low-voltage lamps which produce negligible heat output.

The above-mentioned circuit control module 40 may consist of an electrical device, including either a miroprocessor or other electronic circuitry known to those skilled in the art, for purposes of causing electric current to be supplied to light elements 36. Thus the electric current will cause light elements 36 to illuminate in a sequential fashion, in a blinking manner, or in virtually any other fashion, for purposes of attracting to, and highlighting, display assembly 10.

Additionally, circuit control module 40 may include circuitry to automatically activate illumination system 34 by means of sound activated or movement activated relays. These relays are well known to those skilled in the art and provide optional methods of activating light elements 36 in such a way to attract attention to consumer product 72. An additional advantage of the sound and movement activated relays within circut control module 40 is the reduced consumption of power due to the activation of illumination system 34 only during the presence of a consumer. Electronic controls for performing any of these or other electric control functions are well known to those skilled in the art and are readily available. Therefore the electronic and circuitry details of circuit control module 40 are not described further herein.

In the preferred embodiment of FIG. 1, electrical input sockets 42 are connected to circuit control module 40 by way of conductor wires 38. These input sockets 42 allow illumination system 34 to receive electrical power from battery compartment 52 or other power supply. Input socket holes 50 are located within back plate 42 of display assembly 10 and securely hold input sockets 42 in place, making them accessable from rear wall 44 of back plate 42. Removable battery compartment 52 may be a rectangular box type structure defined by front wall 54 and rear wall 56 opposite thereof, as well as top and bottom walls 58 and 60 joined by parallel side walls 62 and 64. Extending from real wall 56 is power output plug 66. Battery compartment 52 attaches to rear wall 44 of back plate 42 by inserting output plug 66 into input sockets 42. This secures battery compartment 52 in position and also allows the electrical current to transfer from the batteries (not shown) to illumination system 34.

Additionally battery compartment 52 may act as a support structure for display assembly 10 when standing on a horizonal surface, such as a counter top. This will allow display assembly 10 to stand alone in a slightly rearward inclination providing an improved option in displaying consumer product 72.

The interior workings and configuration of battery compartments is well known to those skilled in the art. The electricity supply is incorporated in the form of one or more batteries which may be rechargable or be discarded after depletion. An electrical switch 68 may be located on top wall 58 of battery compartment 52. Switch 68 may be used to start and stop the flow of electrical current from battery compartment 52 to illumination system 34. Optionally, switch 68 could be positioned elsewhere on battery compartment 52, on rear wall 44 of back plate 42, or on frame casing 11. Located on front wall 54 of battery compartment 52 there is also provided coaxial input jack 70 intended to receive a coaxial plug conducting power from an external low voltage AC power source, in which case a suitable power cord and transformer (not shown) may be provided.

It should be understood that although battery compartment 52 as illustrated in the preferred embodiment is removeable, it may also be permanently attached to, or manufactured within, back plate 42. In this optional embodiment output plug 66 and input sockets 41 are eliminated due to battery compartment 52 being directly connected to illumination system 34 by way of conductor wires 38.

Back plate 42, being slightly smaller than frame casing 11 in horizonal and vertical dimensions, is fitted within the back portion of frame casing 11. Back plate 42 may be secured by any traditional means such as screws, glue, pressure, or as seen in detail in FIG. 5 by way of a plurality of inwardly extending tabs 29 which protrude from inside of exterior side walls 24 and 25, and bottom exterior end walls 26 and 28. Tabs 70 extend around rear wall 44 of back plate 42 when back plate 42 is positioned within frame casing 11.

Summary, Ramifications, and Scope

Accordingly, it can be seen that the illuminated display asssembly of the invention provides a unique and advantageous method of displaying consumer products such as video tapes, that is inexpensive to manufacture, assemble and maintain, and offers convenience in changing or replacing the consumer product. Futhermore the illuminated display assembly has the additional advantages in that it may be designed to display a variety of consumer products such as video tapes, compact discs, books, and the like;

it provides a totally inclusive design, requiring no additional storage containers to display consumer product;

it allows the insertion and subsequent displaying of an individual factory sealed video tape;

it allows the insertion and subsequent displaying of an individual empty video tape box;

it allows the insertion and display of a consumer product in such a way as not to alter or multilate the package container, i.e. video box;

it provides a display assembly which has the ability to stand in an upright position;

it provides a visual attractive ambience which contributes to the overall asthetics of the retail environment;

it provides a display assembly which uniquely isolates the consumer product within a series of lights, drawing the attention of the consumer.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A display assembly for a three dimensional retail consumer product comprising:

a frame casing having a general opening adapted to receive said consumer product therewithin, said opening defined by parallel top and bottom interior end walls joined by interior side walls;

said frame casing having a front side through which said consumer product can be placed in said consumer product receiving opening and a rear side opposite thereof;

said top and bottom interior end walls and said interior side walls having dimensions substantially the same as the corresponding horizontal and vertical dimensions of said three dimensional retail consumer product;

barrier means integrally associated with said rear side of said frame casing so as to permit insertion of said consumer product into said consumer product receiving opening only through said front side thereof, said barrier means defined by a back plate integral with said rear side of said frame casing;

a multi-light illumination system encased between said frame casing and said back plate, defined by one or more light elements interconnected by way of conductor wires to a circuit control module;

said light elements being disposed within a front wall of said frame casing through a directly corresponding number of light holes and lenses;

said multi-light illumination system connected to an associated source of electrical power and switch means, whereby upon activation of said switch means, said light elements are illuminated to draw the attention of the consumer to said display assembly and said consumer product displayed therein.

2. The display assembly according to claim 1 wherein said associated source of electrical power is derived from at least one electrical battery housed within a battery compartment.

3. The display assembly according to claim 2 wherein said battery compartment is removable.

4. The display assembly according to claim 1 wherein said switch means comprises a sound activated relay within said circuit control module.

5. The display assembly according to claim 1 wherein said switch means comprises a movement activated relay within said circuit control module.

* * * * *